US006870531B2

(12) United States Patent
Lee et al.

(10) Patent No.: US 6,870,531 B2
(45) Date of Patent: Mar. 22, 2005

(54) CIRCUIT AND METHOD FOR CONTROLLING FRAME RATIO OF LCD AND LCD SYSTEM HAVING THE SAME

(75) Inventors: Hyun-oh Lee, Yongin (KR); Ki-seok Jung, Suwon (KR)

(73) Assignee: Samsung Electronics, Co., Ltd. (KR)

( * ) Notice: Subject to any disclaimer, the term of this patent is extended or adjusted under 35 U.S.C. 154(b) by 381 days.

(21) Appl. No.: 10/244,796

(22) Filed: Sep. 16, 2002

(65) Prior Publication Data

US 2003/0058206 A1 Mar. 27, 2003

(30) Foreign Application Priority Data

Sep. 25, 2001 (KR) ..... 2001-59335

(51) Int. Cl.[7] ..... G09G 5/00
(52) U.S. Cl. ..... 345/211; 713/320; 713/323
(58) Field of Search ..... 713/300, 320, 713/321, 322, 323, 324; 345/211, 212

(56) References Cited

U.S. PATENT DOCUMENTS 4,317,181 A * 2/1982 Teza et al. ..... 713/321
4,670,837 A * 6/1987 Sheets ..... 713/501
6,029,249 A * 2/2000 Atkinson ..... 713/323
6,678,834 B1 * 1/2004 Aihara et al. ..... 713/501
6,691,236 B1 * 2/2004 Atkinson ..... 713/320

FOREIGN PATENT DOCUMENTS

EP 0 655 725 A1 11/1994 ..... G09G/3/36
JP P2001-0015247 2/2001 ..... G09G/3/36

* cited by examiner

*Primary Examiner*—Kent Chang
(74) *Attorney, Agent, or Firm*—Mills & Onello LLP

(57) ABSTRACT

A circuit for variably controlling the frame ratio of a liquid crystal display (LCD) according to an operation mode, and a method for variably controlling the same are provided. A method for displaying received data on a liquid crystal display (LCD) includes the steps of selecting a power save mode, determining whether a data write enable signal for instructing received data to be displayed on an LCD panel is activated, outputting a first frame ratio when the data write enable signal is activated and outputting a second frame ratio when the data write enable signal is deactivated, and displaying the received data on the LCD panel according to the first frame ratio or the second frame ratio. The first frame ratio is larger than the second frame ratio.

12 Claims, 2 Drawing Sheets

CIRCUIT AND METHOD FOR CONTROLLING FRAME RATIO OF LCD AND LCD SYSTEM HAVING THE SAME

BACKGROUND OF THE INVENTION

1. Field of the Invention

The present invention relates to a liquid crystal display (LCD) system, and more particularly, to a circuit for variably controlling the frame ratio of an LCD, a method for variably controlling the same, and an LCD system having the circuit.

2. Description of the Related Art

In general, thin film transistor-liquid crystal displays (TFT-LCDs) commonly employed in mobile phones offer the dual advantages of high color and fast response time. However, the TFT-LCD continuously refreshes a liquid crystal by using an AC signal such as a frame ratio, so as to prevent hardening of the liquid crystal, and thus, the TFT-LCD has the disadvantage of high power consumption, for example as compared to the consumption of a super-twisted nematic (STN) liquid crystal.

In general, although a mobile phone usually displays still image data (hereinafter, referred to as a 'still mode') more often than moving image data (hereinafter, referred to as a 'video mode'), the TFT-LCD used in mobile phones uses an identical frame ratio in both the video mode and the still mode. Thus, the power consumption of the TFT-LCD is not reduced.

SUMMARY OF THE INVENTION

To address the above problems, it is an object of the present invention to provide a circuit for variably controlling the frame ratio of a liquid crystal display (LCD) according to the operation mode, a method for variably controlling the same, and an LCD system having the circuit.

Accordingly, to achieve the object, according to one aspect of the present invention, there is provided a method for displaying received data on a liquid crystal display (LCD) panel. The method includes selecting a power save mode, determining whether a data write enable signal, for instructing received data to be displayed on an LCD panel, is activated, and outputting a first frame ratio when the data write enable signal is activated and a second frame ratio when the data write enable signal is deactivated, and displaying the received data on the LCD panel according to the first frame ratio or the second frame ratio.

To achieve the object, according to another aspect of the present invention, there is provided a method for displaying received data on a liquid crystal display (LCD) panel according to a data write enable signal generated by a main processing unit (MPU) in a power save mode. The method includes (a) determining whether the data write enable signal is activated during a predetermined time period, (b) outputting a first frame ratio or a second frame ratio, according to the result of determination in step (a), and (c) displaying received data on an LCD panel in response to the first frame ratio or the second frame ratio.

To achieve the object, according to another aspect of the present invention, there is provided a circuit for controlling the frame ratio of a liquid crystal display (LCD). The circuit includes a counter for counting a predetermined time period, a circuit for determining whether a data write enable signal is activated, in response to an output signal of the counter, and a circuit for varying the frame ratio in response to an output signal of the circuit for determining.

It is preferable that the circuit for determining outputs a frame ratio control signal in a first state when the data write enable signal is activated during the predetermined time period, and outputs a frame ratio control signal in a second state when the data write enable signal is deactivated during the predetermined time period, and the circuit for varying the frame ratio outputs a first frame ratio in response to the frame ratio control signal being in a first state and outputs a second frame ratio in response to the frame ratio control signal being in a second state.

To achieve the object, according to another aspect of the present invention, there is provided a liquid crystal display (LCD) system. The system includes an LCD panel for displaying received data, a display data random access memory (RAM) for storing the received data in response to a data write enable signal generated by a main processing unit (MPU), a controller for determining whether the data write enable signal is activated during a predetermined time period, and outputting a first frame ratio or a second frame ratio according to the result of determination, and a driver for driving the LCD panel in response to the first frame ratio or the second frame ratio so that the stored data is displayed on the LCD panel.

To achieve the object, according to another aspect of the present invention, there is provided a liquid crystal display (LCD) system for displaying received data on a LCD panel. The system includes a main processing unit (MPU) for outputting a data write enable signal for instructing received data to be displayed on an LCD panel, a display data random access memory (RAM) for storing the received data in response to the data write enable signal, a counter for counting a predetermined time period, a circuit for determining whether the data write enable signal is activated in response to an output signal of the counter, a circuit for varying a frame ratio in response to an output signal of the circuit for determining, and a driver for driving the LCD panel with the data stored in the display data RAM, in response to an output signal of the circuit for varying the frame ratio. It is preferable that the first frame ratio is larger than the second frame ratio.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF PREFERRED EMBODIMENTS

Figure 1:
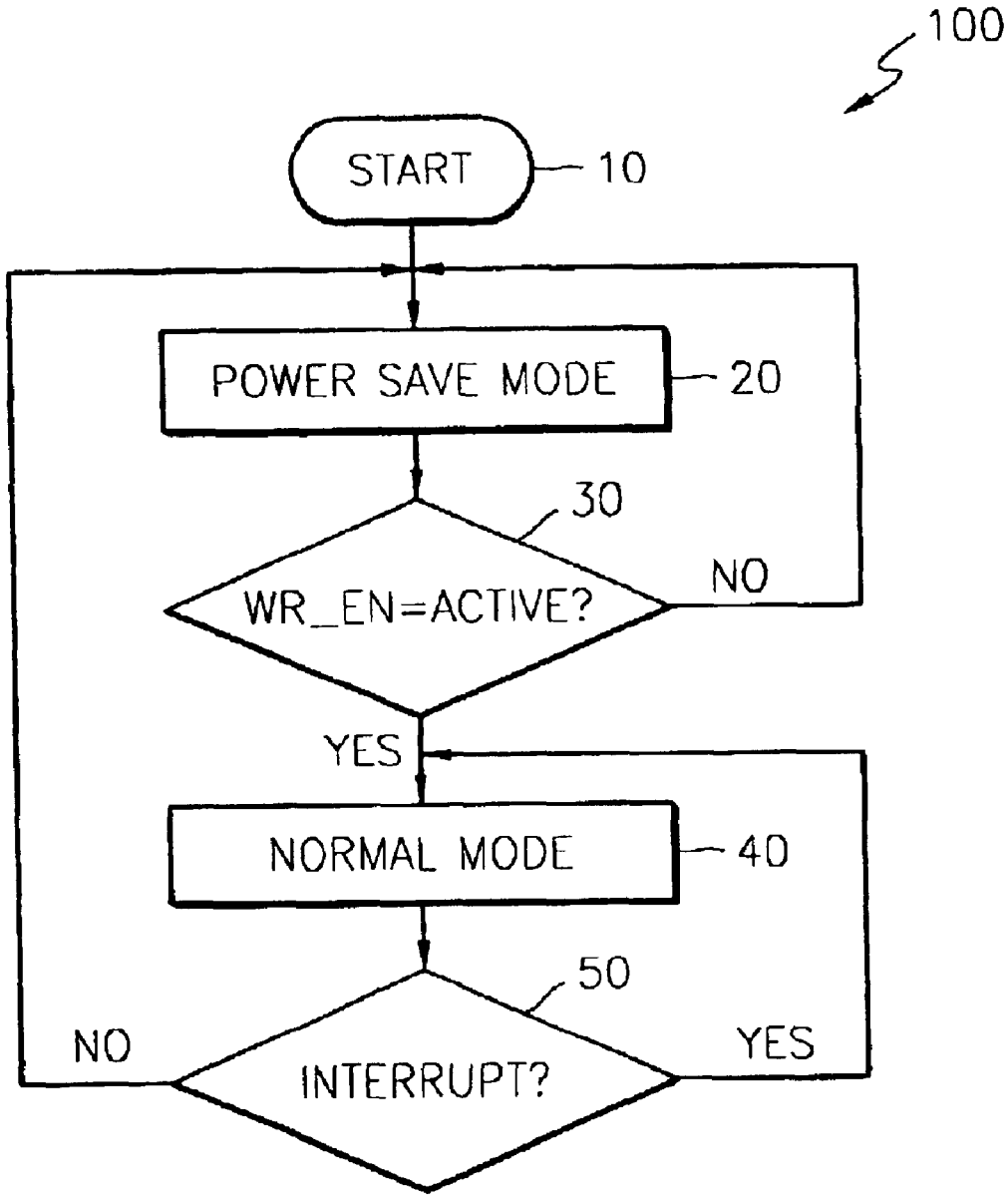
FIG. 1 is a flow chart illustrating steps of controlling the frame ratio of a liquid crystal display (LCD) according to a first embodiment of the present invention.

The present invention will be described more fully hereinafter with reference to the accompanying drawings, in which preferred embodiments of the invention are shown. Like reference numerals refer to like elements throughout the drawings.

FIG. 1 is a flow chart illustrating steps for controlling the frame ratio of a liquid crystal display (LCD) according to a first embodiment of the present invention. Referring to FIG. 1, in step 20, a user can select a normal mode and a power save mode. The power save mode is an operation mode for reducing the frame ratio of a thin film transistor-liquid crystal display (TFT-LCD) so as to reduce power consumption. The operations performed when the LCD is set to power save mode by the user will now be described.

When the user selects power save mode, the frame ratio of the TFT-LCD is reduced from that of normal mode. For example, when the frame ratio in normal mode is 60 Hz, the liquid crystal of the TFT-LCD is phase-inverted sixty times per second. When the frame ratio in power save mode is 5–30 Hz, the liquid crystal of the TFT-LCD is phase-inverted five to thirty times per second. Thus, power consumption while the system is in power save mode is less than that in normal mode.

In step 30, it is determined whether a data write enable signal WR_EN is activated. The data write enable signal WR_EN is, for example, a command instructing display data to be written into a display data random access memory (RAM), and is generated by a main processing unit. When the data write enable signal WR_EN is activated, display data is displayed on the TFT-LCD panel.

When it is determined that the data write enable signal WR_EN is deactivated, power save mode is maintained, as shown in step 20. When it is determined that the data write enable signal WR_EN is activated, the mode is changed to normal mode, and thus, the frame ratio of the TFT-LCD is returned to the frame ratio of normal mode, as shown in step 40. If data of one frame is being displayed when the mode is returned to normal mode and the frame ratio of the TFT-LCD is changed to that of normal mode during its display, then the driving timing of the TFT-LCD varies. Thus, in order to prevent this, it is preferable that the frame ratio of the TFT-LCD is changed to that of normal mode after the last data of the last line of the TFT-LCD has been displayed.

In step 50, it is determined whether an interrupt operation is performed. Here, it is determined whether the data write enable signal WR_EN is activated during a predetermined time, for example, during one frame after a mobile phone is operated in the normal mode, or whether a user changes the operation mode of the mobile phone into another operation mode so as to use the mobile phone. When it is determined that the interrupt operation is performed, the display mode is maintained in normal mode. When it is determined that no interrupt operation is performed, the mode is returned to power save mode.

In other words, the data write enable signal WR_EN is deactivated after being activated in step 30, and the mode is returned to normal mode. If the data write enable signal WR_EN is deactivated again during one frame, the mode is returned to power save mode. In such a case, in order to maintain drive timing of the TFT-LCD, the frame ratio is preferably returned from that of the normal mode to that of the power save mode after the last data of the last line of the TFT-LCD has been displayed.

Figure 2:
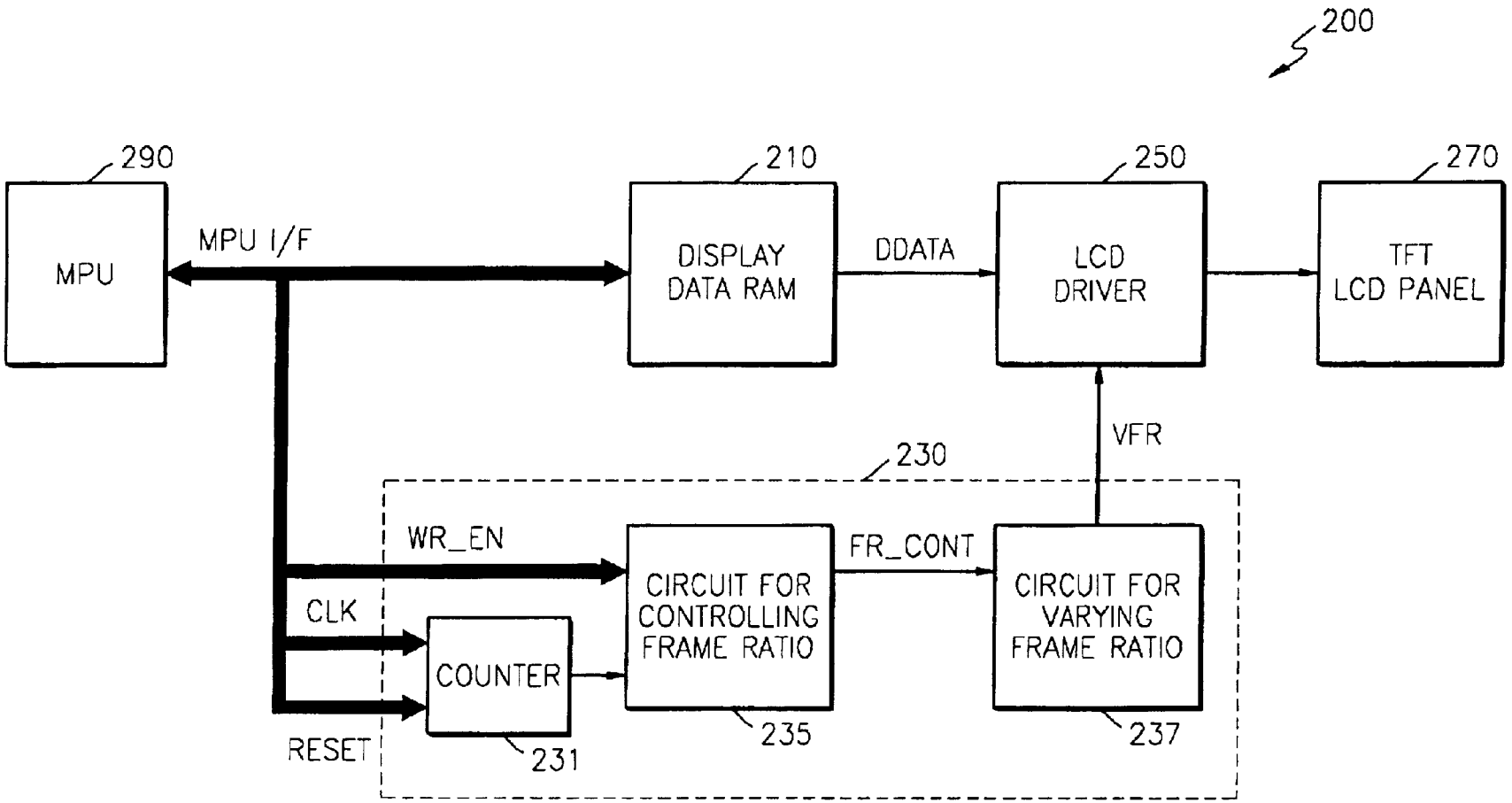
FIG. 2 is a block diagram of an LCD driver system having a circuit for controlling the frame ratio of an LCD according to a second embodiment of the present invention.

FIG. 2 is a block diagram of an LCD driver system having a circuit for controlling the frame ratio of an LCD according to a second embodiment of the present invention. Referring to FIG. 2, the LCD driver system includes a display data random access memory (RAM) 210, a controller 230, an LCD driver 250, a TFT-LCD panel 270, and a main processing unit (MPU) 290.

The main processing unit 290 outputs control signals for controlling the operation of the display data RAM 210 and the controller 230 to the display data RAM 210 and the controller 230 through an MPU interface MPU I/F.

The MPU interface MPU I/F may be a parallel interface or a serial interface, according to the interfacing method, may have a 68 series mode or an 80 series mode according to the kind of MPU, and may use 8 bits or 4 bits according to the data bus line of the MPU.

The MPU interface transmits display data to the display data RAM 210. For example, the MPU interface transmits a data write enable signal WR_EN, which is generated by the MPU 290, to the display data RAM 210.

The size of the display data RAM 210 is matched to the TFT-LCD panel 270, and data to be displayed on the TFT-LCD panel 270 is written into the display data RAM 270. The display data RAM 210 writes display data into liquid crystal cells (not shown) of the TFT-LCD panel 270, in response to the activation of the data write enable signal WR_EN.

The controller 230 controls the frame ratio in response to the data write enable signal WR_EN received from the MPU interface, a clock signal CLK, and a reset signal RESET.

The LCD driver 250 converts display data into multi-high-level data required for driving liquid crystals, in response to an output signal VFR of the controller 230, to drive the liquid crystal of the TFT-LCD panel 270. The LCD driver 250 may be a gate driver (not shown) or a source driver (not shown).

The liquid crystals of the TFT-LCD panel 270 are driven by the output signal of the LCD driver 250, to display data. The controller 230 includes a counter 231, a circuit 235 for controlling the frame ratio, and a circuit 237 for varying the frame ratio.

The counter 231 counts for a predetermined time period in response to the clock signal CLK and outputs the counting result to the circuit 235 for controlling the frame ratio. The circuit 235 for controlling the frame ratio outputs a frame ratio control signal FR_CONT to the circuit 237 for varying the frame ratio, in response to the output signal of the counter 231 and the data write enable signal WR_EN. The circuit 237 for varying the frame ratio outputs a variable frame ratio VFR to the LCD driver 250 in response to the frame ratio control signal FR_CONT.

The operation in which the frame ratio is controlled in power save mode will now be described with reference to FIG. 2.

When the data write enable signal WR_EN is activated, the circuit 235 for controlling the frame ratio outputs the frame ratio control signal FR_CONT in a first state, in response to the data write enable signal WR_EN, and the circuit 237 for varying the frame ratio outputs a first frame ratio VFR to the LCD driver 250, in response to the frame ratio control signal FR_CONT in the first state. The first frame ratio VFR is the same as that in normal mode, and is preferably 60 Hz.

The LCD driver 250 drives the liquid crystal of the TFT-LCD panel 270 in response to the first frame ratio VFR and an output signal DDATA of the display data RAM 210, to display data.

The counter 231 counts for a predetermined time period, for example, for a time period equivalent to one frame after the data write enable signal WR_EN is deactivated, in response to the clock signal CLK. If the data write enable signal WR_EN is deactivated during one frame as the result of counting, the circuit 235 for controlling the frame ratio outputs the frame ratio control signal FR_CONT in a second state in response to the output signal of the counter 231, and the circuit 237 for varying the frame ratio outputs a second frame ratio VFR to the LCD driver 250, in response to the frame ratio control signal FR_CONT in a second state.

The second frame ratio VFR is, for example, the frame ratio in the power save mode, and can be reduced to any degree as long as the TFT-LCD panel 270 does not flicker. For example, the circuit 237 for varying the frame ratio can be designed so that the second frame ratio VFR varies in the range of 5–30 Hz.

The LCD driver 250 drives the liquid crystals of the TFT-LCD panel 270 in response to the second frame ratio VFR and the output signal DDATA of the display data RAM 210, to display data.

When the data write enable signal WR_EN is again activated when the TFT-LCD is operating in power save mode, the circuit 235 for controlling the frame ratio outputs the frame ratio control signal FR_CNT in the first state in response to the output signal of the counter 231. In other words, the mode is returned to normal mode.

In the manner the present invention allows the controller 230 to control the frame ratio according to normal mode and power save mode, in order to reduce the power consumption of the LCD.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method for displaying received data on a liquid crystal display (LCD) panel, the method comprising:

selecting a power save mode;

determining whether a data write enable signal, for instructing received data to be displayed on an LCD panel, is activated, and outputting a first frame ratio for the LCD panel when the data write enable signal is activated and a second frame ratio when the data write enable signal is deactivated; and displaying the received data on the LCD panel according to the first frame ratio or the second frame ratio.

2. The method of claim 1, wherein the first frame ratio is larger than the second frame ratio.

3. A method for displaying received data on a liquid crystal display (LCD) panel according to a data write enable signal generated by a main processing unit (MPU) in a power save mode, the method comprising:

(a) determining whether the data write enable signal is activated during a predetermined time period;

(b) outputting a first frame ratio or a second frame ratio, according to the result of determination in step (a); and (c) displaying received data on an LCD panel in response to the first frame ratio or the second frame ratio.

4. The method of claim 3, wherein the first frame ratio is larger than the second frame ratio.

5. A circuit for controlling the frame ratio of a liquid crystal display (LCD), the circuit comprising:

a counter for counting a predetermined time period;

a circuit for determining whether a data write enable signal is activated during the predetermined time period, in response to an output signal of the counter; and a circuit for varying the frame ratio in response to an output signal of the circuit for determining.

6. The circuit of claim 5, wherein the circuit for determining outputs a frame ratio control signal in a first state when the data write enable signal is activated during the predetermined time period, and outputs a frame ratio control signal in a second state when the data write enable signal is deactivated during the predetermined time period, and wherein the circuit for varying the frame ratio outputs a first frame ratio in response to the frame ratio control signal in a first state and outputs a second frame ratio in response to the frame ratio control signal in a second state.

7. The circuit of claim 6, wherein the first frame ratio is larger than the second frame ratio.

8. A liquid crystal display (LCD) system, the system comprising:

an LCD panel for displaying received data;

a display data random access memory (RAM) for storing the received data in response to a data write enable signal generated by a main processing unit (MPU);

a controller for determining whether the data write enable signal is activated during a predetermined time period, and for outputting a first frame ratio or a second frame ratio according to the result of determination; and a driver for driving the LCD panel in response to the first frame ratio or the second frame ratio to display the stored data on the LCD panel.

9. The system of claim 8, wherein the first frame ratio is larger than the second frame ratio.

10. A liquid crystal display (LCD) system for displaying received data on a LCD panel, the system comprising:

a main processing unit (MPU) for outputting a data write enable signal for instructing received data to be displayed on an LCD panel;

a display data random access memory (RAM) for storing the received data in response to the data write enable signal;

a counter for counting a predetermined time period;

a circuit for determining whether the data write enable signal is activated in response to an output signal of the counter;

a circuit for varying a frame ratio in response to an output signal of the circuit for determining; and a driver for driving the LCD panel with the data stored in the display data RAM, in response to an output signal of the circuit for varying the frame ratio.

11. The system of claim 10, wherein the circuit for determining outputs a frame ratio control signal in a first state when the data write enable signal is activated during the predetermined time period, and outputs a frame ratio control signal in a second state when the data write enable signal is deactivated during the predetermined time period, and wherein the circuit for varying the frame ratio outputs a first frame ratio in response to the frame ratio control signal in a first state and outputs a second frame ratio in response to the frame ratio control signal in a second state.

12. The system of claim 11, wherein the first frame ratio is larger than the second frame ratio.

* * * * *